US007161304B2

(12) United States Patent
Lee et al.

(10) Patent No.: US 7,161,304 B2
(45) Date of Patent: Jan. 9, 2007

(54) ELECTRODELESS LIGHTING SYSTEM

(75) Inventors: Ji-Young Lee, Gyeonggi-Do (KR); Joon-Sik Choi, Seoul (KR); Yun-Chul Jung, Gyeonggi-Do (KR); Yong-Seog Jeon, Gyeonggi-Do (KR); Byeong-Ju Park, Seoul (KR); Hyun-Jung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 284 days.

(21) Appl. No.: 10/950,466

(22) Filed: Sep. 28, 2004

(65) Prior Publication Data

US 2005/0122049 A1 Jun. 9, 2005

(30) Foreign Application Priority Data

Dec. 6, 2003 (KR) ..... 10-2003-0088404

(51) Int. Cl.
*H01J 25/50* (2006.01)

(52) U.S. Cl. ..... 315/39.51; 315/248; 313/493

(58) Field of Classification Search ..... 315/5.13, 315/39.51, 248; 313/493, 567, 638
See application file for complete search history.

(56) References Cited

U.S. PATENT DOCUMENTS 4,498,029 A * 2/1985 Yoshizawa et al. ..... 315/39
6,476,557 B1 * 11/2002 Leng et al. ..... 313/637
6,737,810 B1 * 5/2004 Hochi et al. ..... 315/39

FOREIGN PATENT DOCUMENTS

JP 58-025074 2/1983
JP 7-230793 8/1995

OTHER PUBLICATIONS

U.S. Appl. No. 10/950,463 to Choi et al., filed Sep. 28, 2004.
English language Abstract of JP 58-025074, no date available.
English language Abstract of JP 7-230793, no date available.

* cited by examiner

*Primary Examiner*—Tuyet Vo
*Assistant Examiner*—Jimmy Vu
(74) *Attorney, Agent, or Firm*—Greenblum & Bernstein, P.L.C.

(57) ABSTRACT

Disclosed is an electrodeless lighting system capable of being used as an optical source of an electronic device by being minimized and capable of obtaining an optimum impedance matching and controlling a resonance frequency. The electrodeless lighting system comprises: a magnetron for generating microwave and having an antenna through which the microwave is outputted; a resonator having a resonance space where the microwave is resonated and having an inner diameter partially different along a path that the microwave passes; a bulb installed inside the resonator and having a light emitting material therein for emitting light by the microwave energy; and a microwave feeder of which one side is connected to the antenna and another side thereof is connected to the bulb, for guiding microwave to the bulb, in which a ratio of an outer diameter of the microwave feeder and a ratio of an inner diameter of the resonator corresponding to the outer diameter of the microwave feeder are varied along a progressive direction of the microwave.

20 Claims, 7 Drawing Sheets

ELECTRODELESS LIGHTING SYSTEM

BACKGROUND OF THE INVENTION

1. Field of the Invention

The present invention relates to an electrodeless lighting system, and more particularly, to an electrodeless lighting system capable of being used as an optical source of an electronic device by being minimized and capable of obtaining an optimum impedance matching and controlling a resonance frequency.

2. Description of the Conventional Art

Generally, an electrodeless lighting system using a microwave is a system for generating visible rays or ultraviolet rays from an electrodeless plasma bulb by applying microwave energy to the electrodelsss plasma bulb. The electrodeless lighting system has a longer life span than that of a general incandescent lamp or a fluorescent lamp, and has a higher lighting effect.

FIG. 1 is a longitudinal section view showing one example of an electrodeless lighting system using microwave in accordance with the conventional art.

As shown in FIG. 1, the conventional electrodeless lighting system using microwave comprises: a case 1 having a certain inner space; a magnetron 2 installed inside the case 1 for generating microwave; a high voltage generator 3 for transforming a utility AC power into a high voltage and supplying to the magnetron 2; a waveguide 4 installed at one side of the magnetron 2 for guiding microwave generated from the magnetron 2; a resonator 6 installed at an exit 4*a* of the waveguide 4 to be connected to the waveguide 4 for shielding microwave from being leaked and passing through light; and a bulb 5 installed inside the resonator 6 for exciting an enveloped material by the microwave energy transmitted through the waveguide 4 and emitting light as generating a plasma.

The conventional electrodeless lighting system using microwave is further provided with a reflector 7 formed in front of the case 1, a peripheral area of the resonator 6, for reflecting light generated from the bulb 5 frontward.

A dielectric mirror 8 for passing the microwave transmitted through the waveguide 4 and reflecting the light emitted from the bulb 5 frontward is installed inside the exit 41 of the waveguide 4, and a hole 8*a* penetrated by an axial portion 9 of the bulb 5 is formed in the middle of the dielectric mirror 8.

A cooling fan assembly 10 for cooling the magnetron 2 and the high voltage generator 3 is provided at the rear side of the case 1. Unexplained reference numeral 10*a* denotes a fan housing, 10*b* denotes a blowing fan, M1 denotes a bulb motor, and M2 is a fan motor.

The conventional electrodeless lighting system using microwave is operated as follows.

When a driving signal is inputted to the high voltage generator 3, the high voltage generator 3 transforms an AC power thus to supply a high voltage to the magnetron 2. Then, the magnetron 2 generates microwave having a very high frequency by the high voltage generated from the high voltage generator 3. The generated microwave is guided by the waveguide 4 thus to pass through the exit 4*a* of the waveguide 4 and thereby to be emitted to inside of the resonator 6. By the microwave energy emitted to inside of the resonator 6, an enveloped material inside the bulb 5 is excited and at the same time, a plasma is formed. According to this, light having a specific spectrum is generated, and the light is reflected frontward by the reflector 7 and the dielectric mirror 8 thereby to lighten a lighting space.

However, in the conventional electrodeless lighting system, the waveguide for guiding microwave generated from the magnetron to inside of the resonator is installed between the high voltage generator and the magnetron. According to this, the entire system size is increased as much as a volume of the waveguide. Therefore, it is difficult to minimize the entire size of the system and thereby the electrodeless lighting system is used only as a lighting system for a high output.

SUMMARY OF THE INVENTION

Therefore, an object of the present invention is to provide an electrodeless lighting system capable of being used not only as a lighting but also a low output optical source of an electronic device by being minimized.

Another object of the present invention is to provide an electrodeless lighting system constructed for an optimum impedance matching and capable of controlling a resonance frequency.

To achieve these and other advantages and in accordance with the purpose of the present invention, as embodied and broadly described herein, there is provided an electrodeless lighting system comprising: a magnetron for generating microwave and having an antenna through which the microwave is outputted; a resonator having an inner diameter partially different along a path that the microwave passes and having a space that the microwave is resonated; a bulb installed inside the resonator and having a light emitting material therein for emitting light by the microwave energy; and a microwave feeder of which one side is connected to the antenna and another side thereof is connected to the bulb for guiding microwave to the bulb, in which a ratio of an outer diameter of the microwave feeder and a ratio of an inner diameter of the resonator corresponding to the outer diameter of the microwave feeder are varied along a progressive direction of the microwave.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

An electrodeless lighting system according to the present invention will be explained in more detail with reference to the attached drawings.

Figure 1:
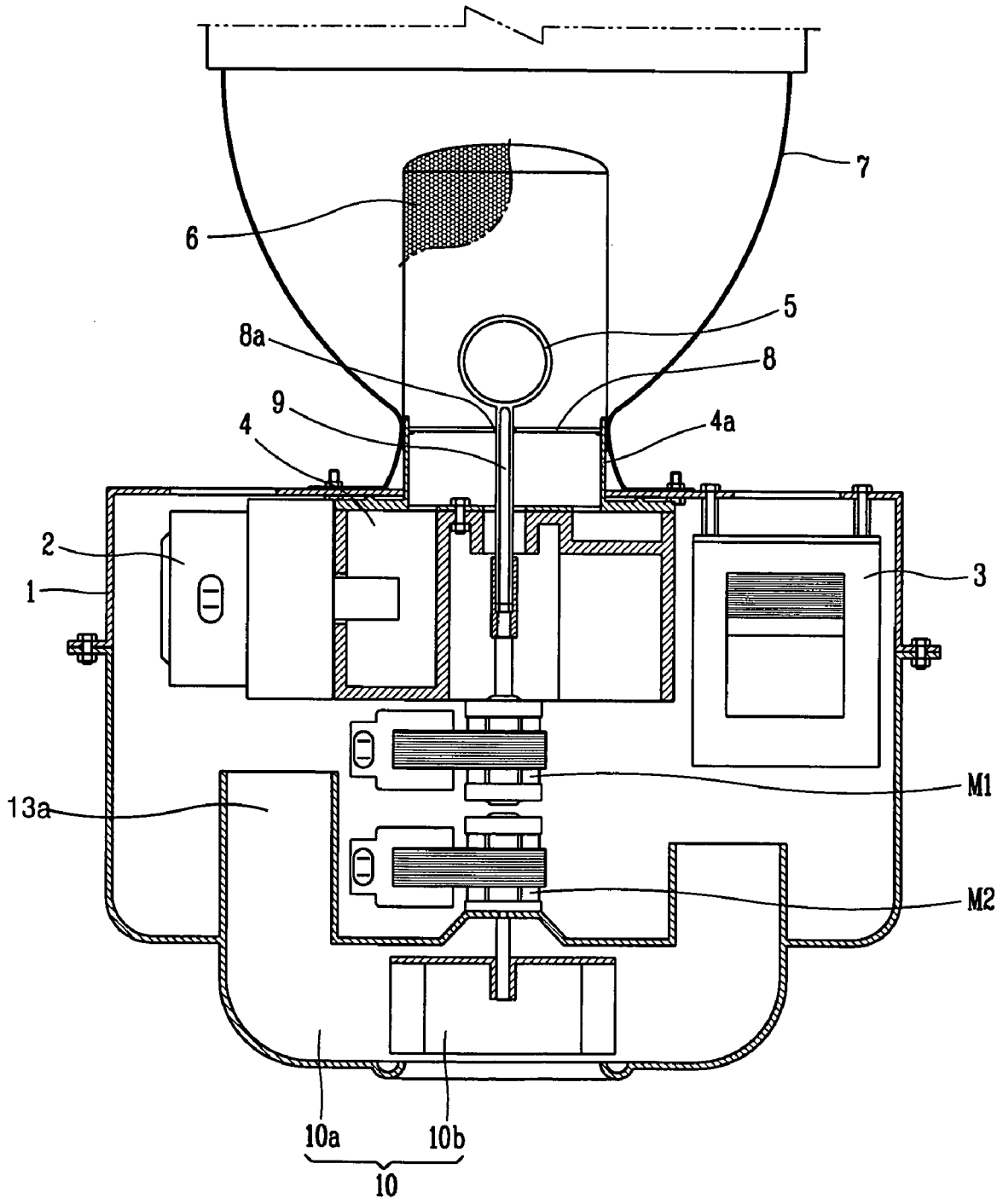
FIG. 1 CONVENTIONAL ART
FIG. 1 is a longitudinal section view showing an electrodeless lighting system in accordance with the conventional art.
Figure 2:
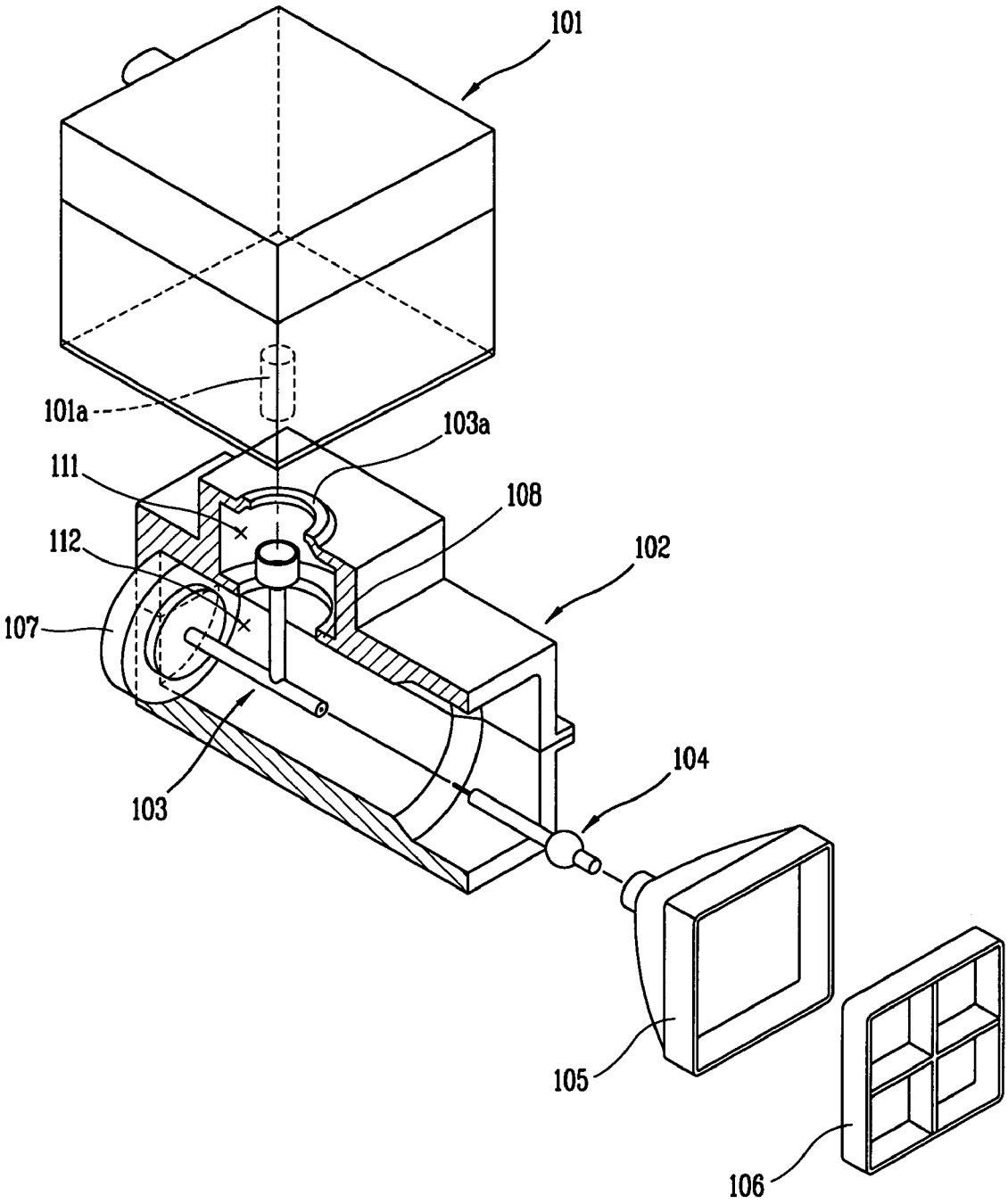
FIG. 2 is a disassembled perspective view showing an electrodeless lighting system of a low output according to the present invention.
Figure 3:
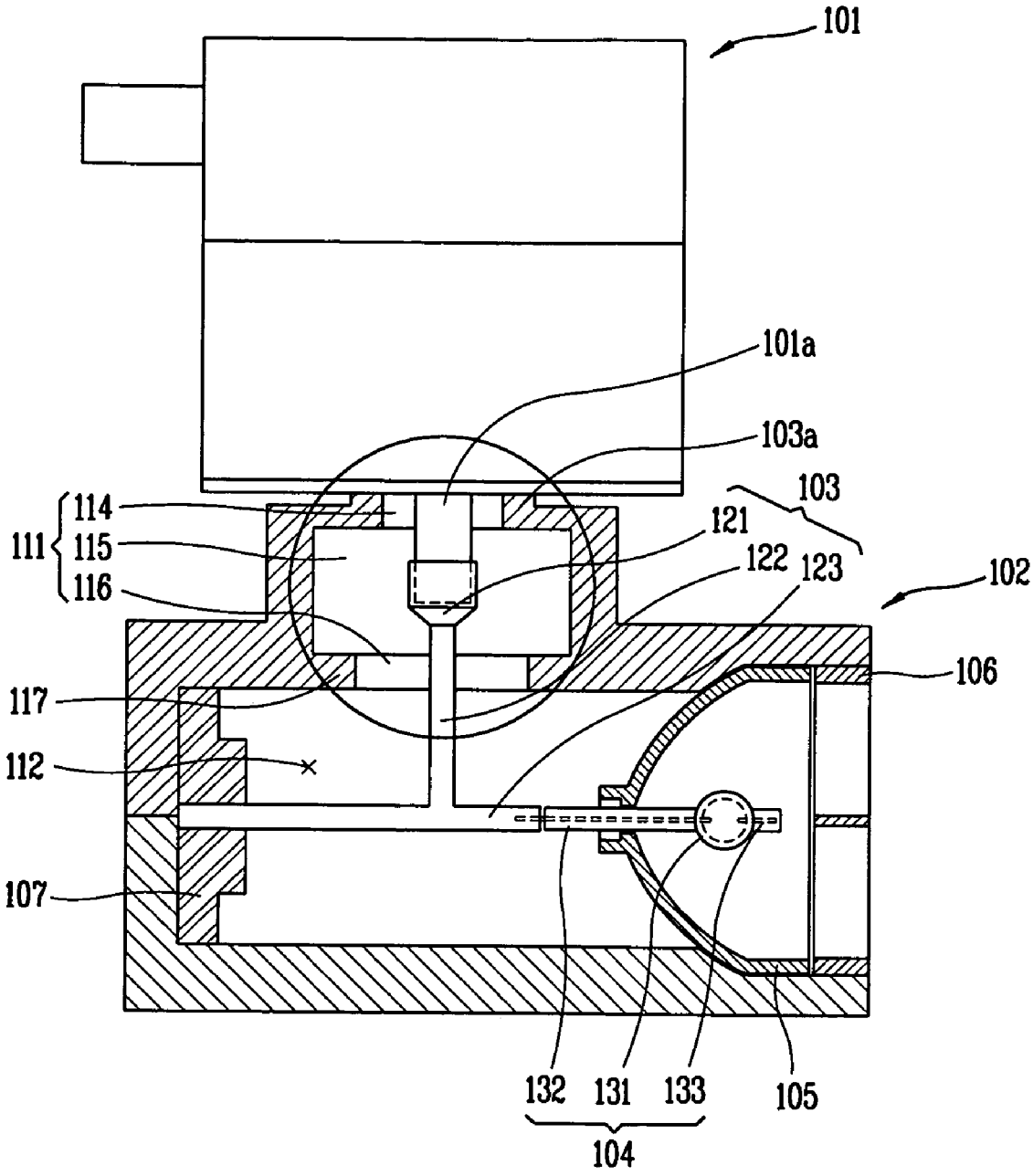
FIG. 3 is a longitudinal section view showing the electrodeless lighting system of a low output according to the present invention.

FIG. 2 is a disassembled perspective view showing an electrodeless lighting system according to the present invention, and FIG. 3 is a longitudinal section view showing the electrodeless lighting system according to the present invention.

As shown in FIGS. 2 and 3, the electrodeless lighting system according to the present invention comprises: a magnetron 101 for emitting microwave generated therein accordingly as an external power source is applied through an antenna provided at one side thereof; a resonator 102 to which one surface of the magnetron 101 is mounted so that the antenna 101*a* can be positioned therein, having a resonance space therein of which inner diameter becomes partially different along a path that the microwave passes, and for resonating the microwave in the resonance space; a bulb 104 positioned at the resonance space of the resonator 102, having an enveloped material therein, the material excited by the resonated microwave, and for emitting light by forming a plasma; a microwave feeder 103 positioned in the resonance space of the resonator 102, having one side connected to the antenna 101*a* of the magnetron 101 and another side connected to the bulb 104 for guiding microwave to the bulb 104 from the antenna 101*a;* a reflector 105 for reflecting light generated accordingly as the enveloped material is excited by the microwave energy frontward; and a window 106 mounted at the front surface of the reflector 105 for shielding electromagnetic wave from being leaked and protecting the bulb 104.

The resonator 102 is composed of a first resonating portion 111 formed as a conductor, having a penetration hole at one surface thereof so that the magnetron 101 can be mounted and thereby the antenna 101*a* can be inserted thereinto, and provided with a resonance space of a multi-step on the same axis, the resonance space having an inner diameter that becomes partially different; and a second resonating portion 112 perpendicular to the first resonating portion 111 to be connected to the first resonating portion 111, having a cylindrical resonating space of a certain diameter, and provided with the bulb 104 in the resonating space.

The first resonating portion 111 includes: an introduction portion 114 through which the antenna 101 passes; an expansion portion 115 extended from the introduction portion 114, connected to the antenna 101*a* and the microwave feeder 103, and through which the microwave feeder 103 passes; and a contraction portion 116 formed as a resonance space inside a protrusion portion 117 through the space the microwave feeder 103 passes, the protrusion portion 117 protruded at the inner circumferential surface of the expansion portion 115 where the expansion portion 115 and the second resonating portion 112 are connected to each other in a circumferential direction with a certain thickness and length towards the center axis of the expansion portion 115.

It is preferable to design the first resonating portion so that the inner diameters of the introduction portion 114, the expansion portion 115, and the contraction portion 116 can be different. Also, the inner diameter of the contraction portion 116 is preferably designed to be larger than the inner diameter of the introduction portion 114. However, the inner diameter of the contraction portion 116 may be designed to be smaller than that of the introduction portion 114 according to a design variable.

A mounting portion 103*a* protruded with a certain height is formed at the outer circumferential surface of the introduction portion 114 of the first resonating portion 111. On the mounting portion 103*a*, the magnetron 101 is mounted so that the antenna 101*a* can be inserted into the introduction portion 114.

The microwave feeder 103 formed as a conductor is composed of: a connection portion 121 having an insertion groove therein so that the antenna 101 can be inserted thus to be connected thereto, having an outer diameter larger than a diameter of the antenna 101*a*, and positioned in the resonance space of the expansion portion 115; a first feeder 122 integrally formed at one side of the connection portion 121 and extended from the expansion portion 115 to the second resonating portion 112 via the contraction portion 116; and a second feeder 123 vertically connected to the first feeder 122 in the second resonating portion 112 and having one end connected to the bulb 104.

The first feeder 122 is preferably formed on the same axis as the antenna 101*a* and the connection portion 121 of the microwave feeder 103 for a smooth transmission of microwave generated from the magnetron 101 and an optimum frequency matching. The first feeder 122 is preferably arranged to cross the center of the resonance space formed at the first resonating portion 111, the resonance space where the diameters of the antenna 101, the connection portion 121 of the microwave feeder 103, and the first feeder 121 are gradually varied from the introduction portion 114 to the contraction portion 116.

The diameter of the first feeder 122 is formed to be smaller than that of the connection portion of the microwave feeder 103. However, it is also possible to form the diameter of the first feeder 122 to be smaller or larger than that of the antenna 101 according to an impedance matching and a resonant frequency.

Also, an effective impedance matching is possible and a resonant frequency is controlled by varying the outer diameters of the antenna 101*a* and the microwave feeder 103 and the inner diameter of the resonator 102 corresponding to the outer diameters of the antenna 101*a* and the microwave feeder 103 along a progressive direction of microwave.

That is, ratios between the inner diameters of the resonance space inside the first resonating portion 111 and the outer diameters of the antenna 101*a*, the connection portion 121 of the microwave feeder 103, and the first feeder 122 respectively corresponding to the inner diameter of the resonance space are differently set.

Figure 4:
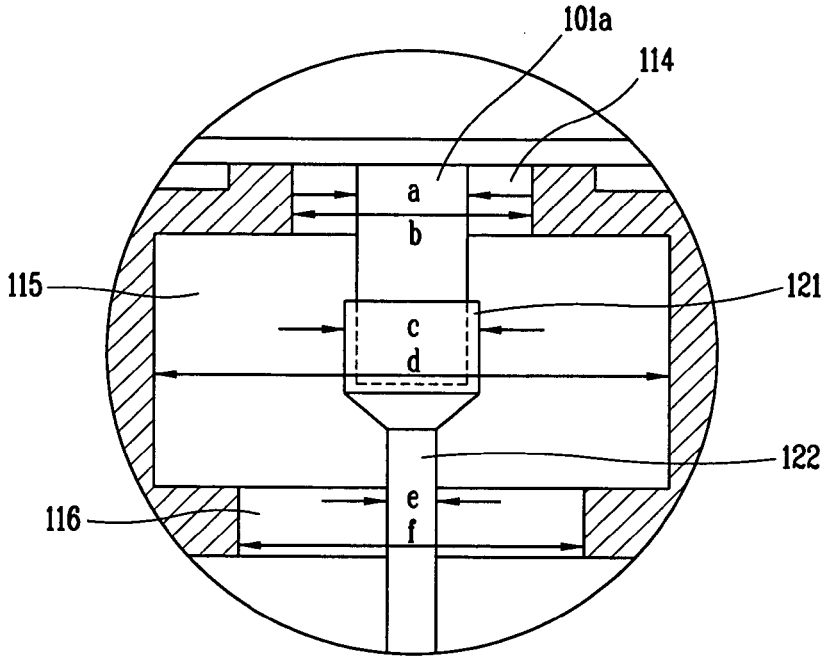
FIG. 4 is an enlarge view showing a first resonating portion according to the present invention.

More specifically, as shown in FIG. 4 showing the first resonating portion 111 of the electrodeless lighting system according to the present invention, a ratio between the outer diameter 'a' of the antenna 101*a* and the inner diameter 'b' of the introduction portion 114, a ratio between the outer diameter 'c' of the connection portion 121 of the microwave feeder 103 and the inner diameter 'd' of the expansion portion 115, and a ratio between the outer diameter 'e' of the first feeder 122 and the inner diameter 'f' of the contraction portion 116 are differently set.

It is also preferable to construct in such a manner that a ratio between the outer diameter 'a' of the antenna 101*a* and the inner diameter 'd' of the expansion portion 115 through which the antenna 101*a* passes, and a ratio between the outer diameter 'e' of the first feeder 122 and the inner diameter 'd' of the expansion portion 115 through which the first feeder 122 passed are differently set.

According to this, the impedance matching of the electrodeless lighting system according to the present invention can be effectively obtained and the resonant frequency can be effectively controlled.

For more effective impedance matching and resonant frequency, a resonant frequency controlling means 107 is installed inside the second resonating portion 112 as shown in FIGS. 2 and 3.

The resonant frequency controlling means 107 is installed at the opposite side to the bulb 104 installation side, that is, at the wall surface of the rear side of the cylindrical second resonating portion 112.

The resonant frequency controlling means 107 is provided with a penetration hole at the center thereof for inserting one end of the second feeder 123, and is formed as a disc shape that varies a volume of the resonance space of the second resonating portion 112 by moving back and forth along the second feeder 123.

The resonant frequency controlling means 107 formed as a disc shape is fixed at a position that an optimum impedance matching and an optimum resonant frequency are obtained.

The position of the resonant frequency controlling means 107 is determined manually or by an external device before a packing of the resonator 102, so that an additional device for controlling the position of the resonant frequency controlling means 107 is not required inside the electrodeless lighting system of the present invention.

The resonant frequency controlling means 107 can be formed as several shapes for more effective impedance matching and resonant frequency.

Figure 5:
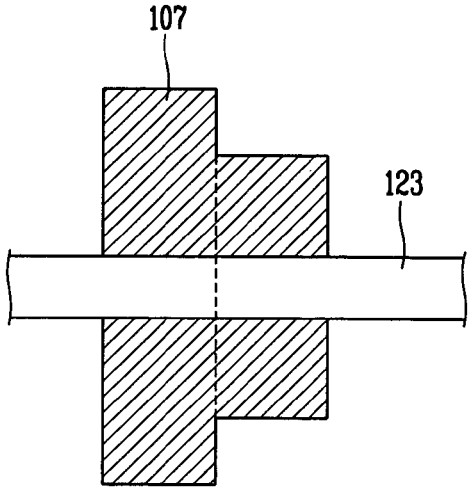
FIG. 5 is a longitudinal section view showing one embodiment of a resonant frequency controlling means according to the present invention.
Figure 6:
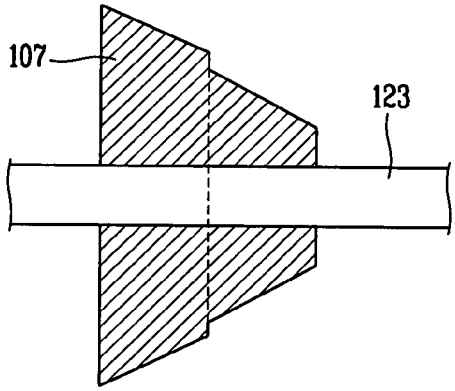
FIG. 6 is a longitudinal section view showing another embodiment of the resonant frequency controlling means according to the present invention.

FIGS. 5 and 6 are longitudinal section views showing the resonant frequency controlling means.

As shown in FIG. 5, the disc body is formed of a conductor and is formed as a multi-step that the outer diameters are different from each other. The diameter of the largest disc is matched with the inner diameter of the second resonating portion 112 so that the volume of the resonance space of the second resonating portion 112 can be controlled when the resonant frequency controlling means 107 moves back and forth.

As shown in FIG. 6, the outer circumferential surface of the multi-step of the disc body can be inclined with a certain angle.

In the low output electrodeless lighting system according to the present invention, at least one stub 125 can be additionally installed inside the second resonating portion 112 for more effective impedance matching and resonant frequency and for an optimum transmission of microwave to the bulb.

Figure 7:
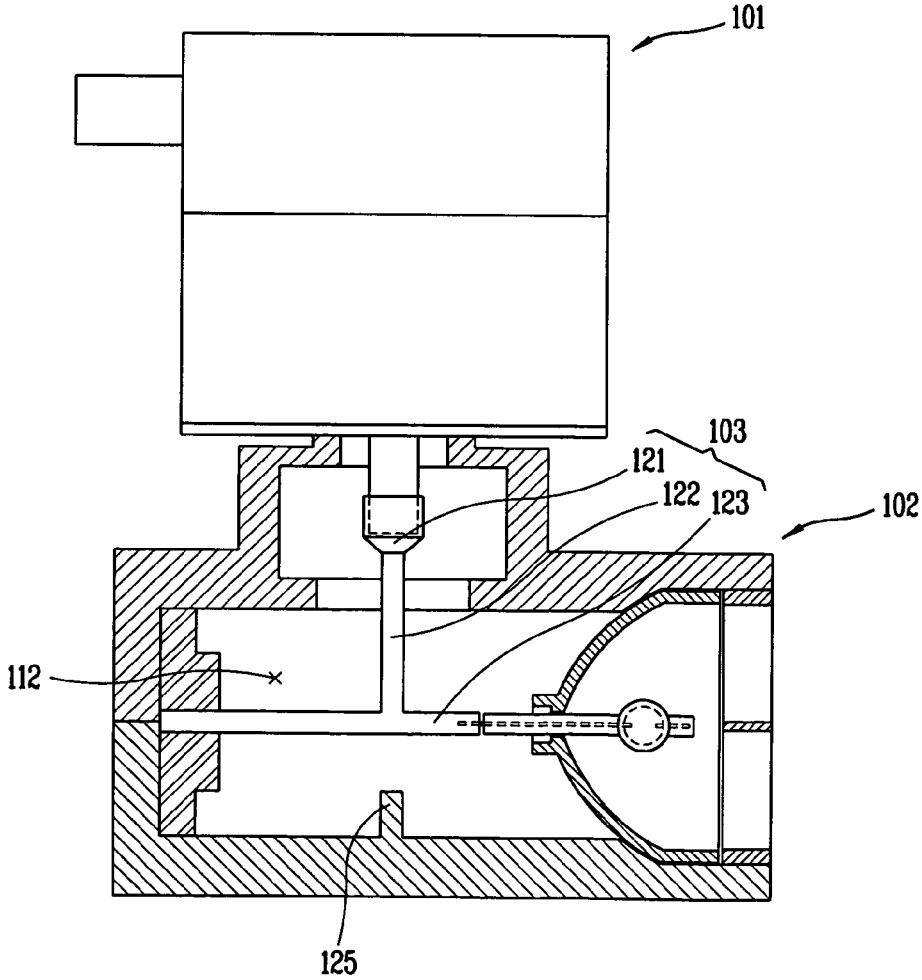
FIG. 7 is a longitudinal section view showing one embodiment of an installation state of a stub according to the present invention.

As shown in FIG. 7, at least one stub 125 is installed at the inner circumferential wall surface of the second resonating portion 112. The stub 125 is installed to be towards the second feeder 123 crossing the center of the second resonating portion 112.

As shown in FIG. 7, the stub 125 is preferably formed on the same axis as the first feeder 122.

Figure 8:
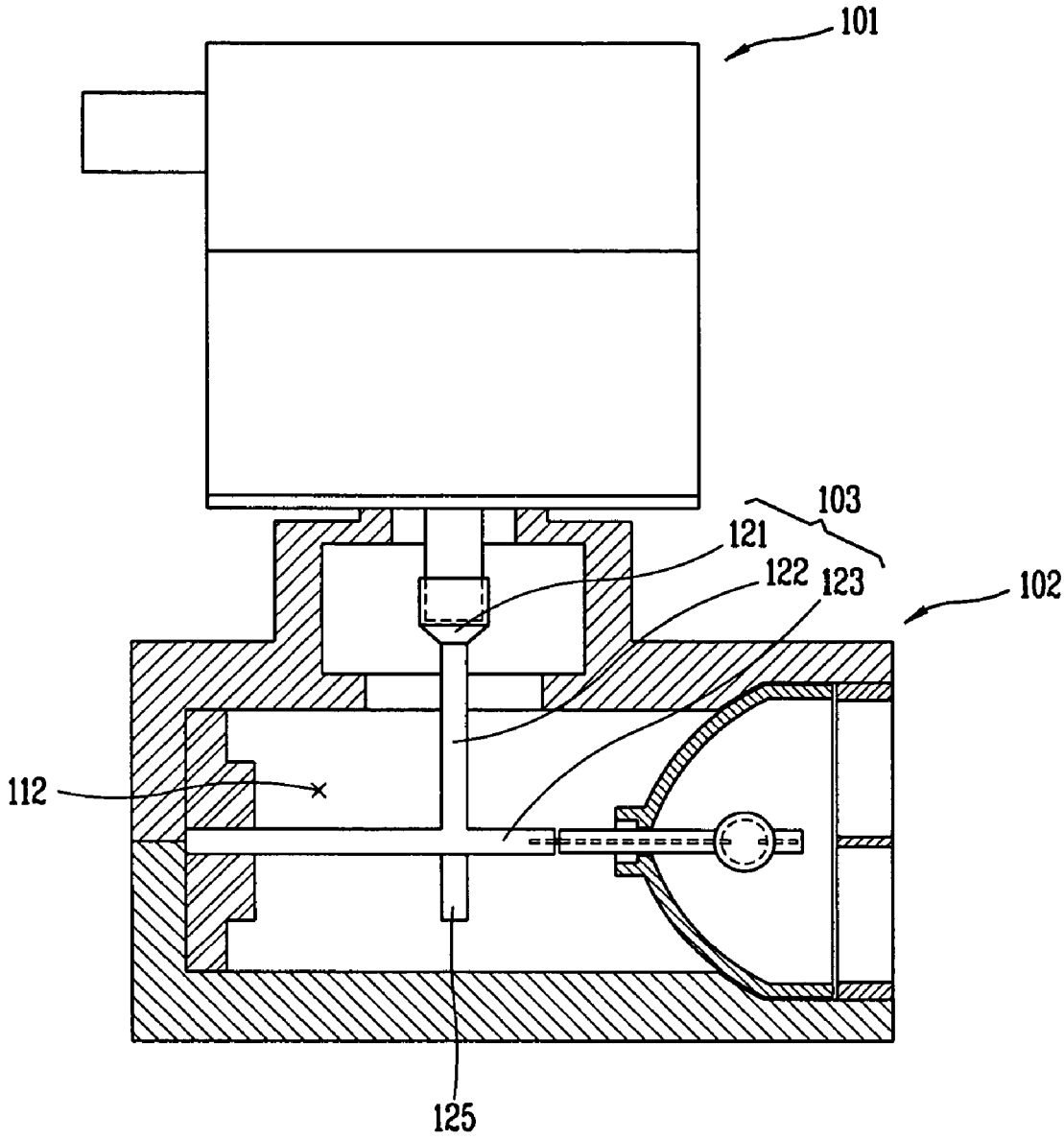
FIG. 8 is a longitudinal section view showing another embodiment of the installation state of the stub according to the present invention.

As shown in FIG. 8, the stub 125 is protruded at one side of the second feeder 123 with a certain height, and is preferably positioned on the same axis as the first feeder 122.

Figure 9:
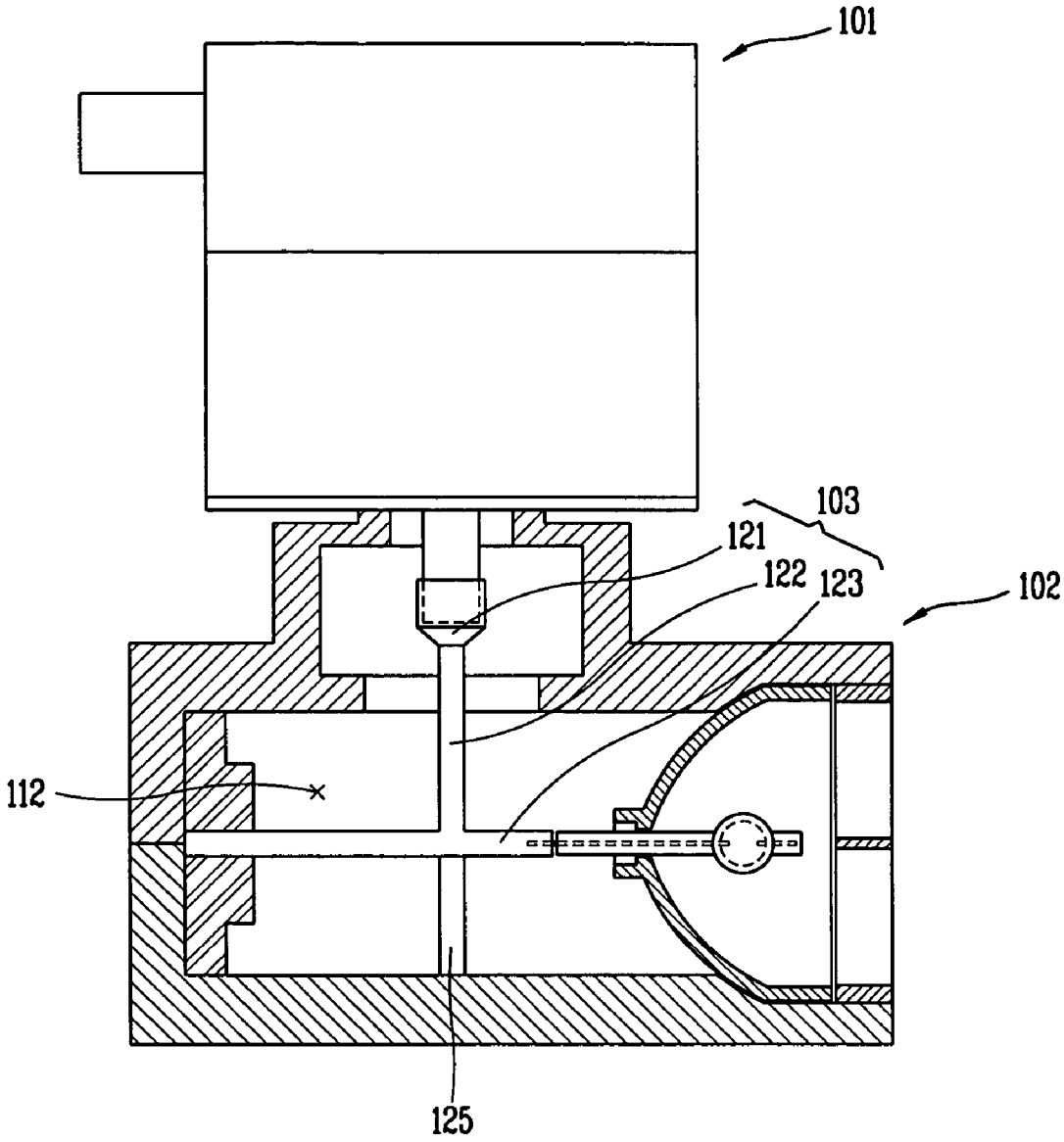
FIG. 9 is a longitudinal section view showing still another embodiment of the installation state of the stub according to the present invention.

As shown in FIG. 9, the stub 125 is formed to connect the inner wall surface of the second feeder 123 and the inner wall surface of the second resonating portion 112. Herein, the stub 125 is positioned on the same axis as the first feeder 122.

The stub 125 variously installed inside the second resonating portion 112 is formed as a polygon or a cylindrical shape.

A method for installing the stub 125 inside the second resonating portion 112 includes a composite method of the aforementioned plural modification examples.

As aforementioned, by controlling the installation position, the shape, and the size of the stub 125 positioned inside the second resonating portion 112, microwave can be more effectively transmitted to the bulb side.

The bulb 104 is composed of: a light emitting portion 131 of a sphere shape having a predetermined inner volume in which a light emitting material is enveloped; a supporting portion 132 integrally extended from the light emitting portion 131 and connected to one end of the second feeder 123; and a pair of electrodes 133 arranged to be opposite to each other in the light emitting portion 131.

The light emitting portion 131 is preferably formed of a material having a high light transmittance ratio and a low dielectric loss such as a quartz. A light emitting material enveloped in the light emitting portion 131 includes: a light emitting material such as a metal, a halogen group compound, sulfur, etc. for inducing a light emission by forming a plasma; inactive gas such as argon gas, krypton gas, etc. for forming a plasma in the light emitting portion 131 at the initial state of the light emission; and a discharge catalyst material such as Hg for facilitating lighting by catalyzing the initial discharge or for controlling a generated light spectrum.

The supporting portion 132 formed of the same material as the light emitting portion 131 is extended from the light emitting portion 131, and is positioned on the same axis as the second feeder 123 of the microwave feeder 103. One arc focusing support 133 is partially protruded outwardly at the inner side of the supporting portion 132, and the end portion of the protruded arc focusing support 133 is inserted into the end portion of the second feeder 123.

The reflector 105 is formed as an oval shape having a certain curvature or a similar shape as the oval shape, and is installed between the second feeder 123 and the bulb 104 to cover one side of the bulb 104, thereby reflecting light generated from the bulb 104 frontward.

The window 106 is installed at an opening portion of the reflector 105, and is formed as a lattice form for passing light generated from the bulb 104 and preventing a leakage of microwave.

The window 106 can be formed as a transparent plate type for passing light and preventing a harmful material sealed in the bulb 104 from being leaked outwardly at the time of the bulb 104 damage. The window 106 can have any form such as a mesh form, etc. and can be formed of any material if light can be passed and microwave can be shielded.

Operation of the low output electrodeless lighting system according to the present invention will be explained as follows.

Microwave is generated from the magnetron 101 thus to be outputted through the antenna 101*a*. The microwave passes through the first resonating portion 111 of the resonator 102 that the ratios between the inner diameters of the multi-step resonating space and the outer diameters of the microwave guide means, that is, the antenna 101*a*, the connection portion 121 of the microwave feeder 103, and the first feeder 123 are differently set. The microwave that has passed through the first resonating portion 111 is guided to the bulb 104 through the first feeder 122 and the second feeder 123 with being resonated in the second resonating portion 112 where the resonant frequency controlling means 107 fixed to a predetermined position and at least one stub 125 are formed under a state that an optimum impedance matching and a resonant frequency are obtained.

The microwave transmitted to the bulb 104 forms a strong electric field between the arc focusing supports 133 installed at the light emitting portion 141 of the bulb 104, and the inactive gas sealed at the inner side of the light emitting portion 141 is excited by the electric field. The heat generated at the time of the discharge vaporizes the light emitting material thus to form a plasma, and the plasma continuously maintains the discharge by the microwave, thereby emitting light of a high luminosity. The light is reflected frontward by the reflector 105 thus to be used as a necessary optical source.

As aforementioned, in the electrodeless lighting system according to the present invention, the antenna of the magnetron is positioned at the resonance space of the first resonating portion formed inside the resonator, and the microwave feeder connected to the antenna is installed inside the first and second resonating portions of the resonator. According to this, the microwave generated from the magnetron is guided to the bulb along the microwave feeder thus to emit light. Therefore, an additional device such as a waveguide, a high voltage generator, a motor, etc. is not required, and thereby the electrodeless lighting system can be fabricated as a very small size thus to be used as an optical source of a small type such as an optical source of a projection TV.

Also, since the ratios between the inner diameters of the multi-step resonance space of the first resonating portion and the outer diameters of the microwave transmission means, that is, the antenna, the connection portion of the microwave feeder, and the first feeder are differently set, an optimum impedance matching and a resonant frequency are obtained. According to this, microwave energy transmitted to the bulb can be optimized.

Also, by installing the resonant frequency controlling means inside the second resonating portion and by additionally forming at least one stub, the impedance matching and resonant frequency can be more effective.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless lighting system comprising:

a magnetron for generating microwave and having an antenna through which the microwave is outputted;

a resonator having a resonance space where the microwave is resonated and having an inner diameter partially different along a path that the microwave passes;

a bulb installed inside the resonator and having a light emitting material therein for emitting light by the microwave energy; and a microwave feeder of which one side is connected to the antenna and another side thereof is connected to the bulb, for guiding microwave to the bulb, in which a ratio of an outer diameter of the microwave feeder and a ratio of an inner diameter of the resonator corresponding to the outer diameter of the microwave feeder are varied along a progressive direction of the microwave.

2. The electrodeless lighting system of claim 1, wherein the resonator is composed of:

a first resonating portion to which the antenna is inserted and provided with a multi-step resonance space therein on the same axis, the resonance space having different inner diameters partially; and a second resonating portion having a cylindrical resonance space perpendicular to the first resonating portion to be connected to the first resonating portion, and having the bulb therein.

3. The electrodeless lighting system of claim 2, wherein the first resonating portion includes:

an introduction portion through which the antenna passes;

an expansion portion extended from the introduction portion, connected to the antenna and the microwave feeder, and through which the microwave feeder passes; and a contraction portion formed as a resonance space inside a protrusion portion through the space the microwave feeder passes, the protrusion portion protruded at the inner circumferential surface of the expansion portion with a certain width and length towards the center axis of the expansion portion.

4. The electrodeless lighting system of claim 3, wherein inner diameters of the introduction portion, the expansion portion, and the contraction portion are different from one another.

5. The electrodeless lighting system of claim 1, wherein the microwave feeder is composed of:

a connection portion having an insertion groove therein so that the antenna can be inserted thus to be connected thereto, and positioned in the resonance space of the expansion portion;

a first feeder integrally formed at one side of the connection portion and extended from the expansion portion to the second resonating portion via the contraction portion; and a second feeder vertically connected to the first feeder in the second resonating portion and having one end connected to the bulb.

6. The electrodeless lighting system of claim 5, wherein the connection portion and the first feeder are arranged to cross the center of the first resonating portion.

7. The electrodeless lighting system of claim 5, wherein a ratio between the outer diameter of the antenna and the inner diameter of the introduction portion through which the antenna passes, a ratio between the outer diameter of the connection portion and the inner diameter of the expansion portion through which the connection portion passes, and a ratio between the outer diameter of the first feeder and the inner diameter of the contraction portion through which the first feeder passes are respectively differently set.

8. The electrodeless lighting system of claim 5, wherein a resonant frequency controlling means for controlling a resonant frequency of microwave introduced into the second resonating portion is installed in the second resonating portion.

9. The electrodeless lighting system of claim 8, wherein the resonant frequency controlling means is provided with a penetration hole at the center thereof for inserting one end of the second feeder, and is formed as a disc shape that varies a volume of the resonance space of the second resonating portion by moving back and forth along the second feeder.

10. The electrodeless lighting system of claim 9, wherein the disc type is formed as a multi-step that the outer diameters are different from one another.

11. The electrodeless lighting system of claim 10, wherein an outer circumferential surface of the multi-step of each disc type is inclined with a certain angle.

12. The electrodeless lighting system of claim 9, wherein the disc body is a conductor.

13. The electrodeless lighting system of claim 2, wherein the inner circumferential surface of the resonance space of the second resonating portion is provided with at least one stub protruded with a certain height for an impedance matching and a resonant frequency.

14. The electrodeless lighting system of claim 13, wherein the stub is formed as a cylindrical shape.

15. The electrodeless lighting system of claim 13, wherein the stub is formed as a polygon shape.

16. The electrodeless lighting system of claim 7, wherein the second feeder is provided with a stub protruded with a certain height for a resonant frequency and an impedance matching at one side thereof.

17. The electrodeless lighting system of claim 16, wherein the stub is formed on the same axis as the first feeder.

18. The electrodeless lighting system of claim 16, wherein the stub has a protruded one end that is connected to the inner circumferential surface of the resonance space of the second resonating portion.

19. The electrodeless lighting system of claim 16, wherein the stub is formed as a cylindrical shape.

20. The electrodeless lighting system of claim 16, wherein the stub is formed as a polygon shape.

* * * * *